United States Patent [19]

Bellocci et al.

[11] 4,008,749

[45] Feb. 22, 1977

[54] METHOD FOR LOW-PRESSURE CASTING IN A SAND MOULD

[75] Inventors: Rio Bellocci; Michel Degois, both of Pont-a-Mousson, France

[73] Assignee: Pont-A-Mousson S.A., Nancy, France

[22] Filed: Dec. 19, 1975

[21] Appl. No.: 642,631

[30] Foreign Application Priority Data

Dec. 24, 1974 France ..... 74.42713

[52] U.S. Cl. ..... 164/66; 164/119; 164/137

[51] Int. Cl.[2] ..... B22D 17/06

[58] Field of Search ..... 164/119, 303–311, 164/66, 137

[56] References Cited

UNITED STATES PATENTS

| | | | |
|---|---|---|---|
| 1,797,041 | 3/1931 | Becker | 164/309 |
| 3,163,897 | 1/1965 | Sylvester | 164/119 |
| 3,532,154 | 10/1970 | Balevski et al. | 164/119 |
| 3,628,598 | 12/1971 | MacNeill et al. | 164/309 X |

FOREIGN PATENTS OR APPLICATIONS

| | | | |
|---|---|---|---|
| 22,428 | 4/1948 | Finland | 164/309 |

*Primary Examiner*—Robert D. Baldwin
*Attorney, Agent, or Firm*—Sughrue, Rothwell, Mion, Zinn & Macpeak

[57] ABSTRACT

A mould cavity for casting the part is supplied with liquid metal by a main runner formed in the mould and connected to the upper end of a supply pipe whose sectional size is in the neighborhood of the sectional size of the main runner and which extends into a fluid-tight vessel containing the liquid metal. The metal is supplied to the mould cavity by the action of a gas pressure on the free surface of the metal in the vessel.

According to the invention, the mould cavity is supplied with the metal from the main runner through a secondary runner whose sectional size is much less than the sectional size of the main runner, and the gas pressure is maintained until the secondary runner has solidified whereafter the gas pressure is returned to atmospheric pressure, whereby the liquid metal in the main runner and supply pipe returns to the vessel.

17 Claims, 6 Drawing Figures

METHOD FOR LOW-PRESSURE CASTING IN A SAND MOULD

The present invention relates to an improved method for low-pressure casting in a sand mould and to apparatus for carrying out this method. The invention more particularly concerns the casting of metals having a high melting point, such as grey cast iron or spheroidal graphite cast iron, but it is also applicable to the casting of other metals or alloys, ferrous or otherwise.

The method of low-pressure casting is already known. In this method, an impression of the mould is supplied with metal through a main runner which is formed in the mould and connected to the upper end of a supply pipe which has a sectional size in the neighbourhood of the sectional size of the runner and extends through a fluidtight vessel containing the liquid metal and has a lower end immersed in this metal, the metal being supplied to the impression by the action of a gas pressure higher than atmospheric pressure on the free surface of the metal contained in the vessel. The word "impression" is intended to mean a mould cavity having the shape of a part to be cast and the word "runner" is intended to mean a conduit supplying metal to this cavity.

In the known method, the main runner opens directly into the cavity and in order to recover the metal contained in the supply pipe and in the main runner in the liquid form, the mould cavity is isolated by a closure member as soon as it is filled. In this way it is possible to release the pressure upon closure and rapidly release the end of the supply pipe and immediately connect a new mould to be filled to the pipe.

Such a method has the major drawback of requiring, on one hand, a closure device and, on the other, at least one large feed head for the moulding cavity which is isolated and remote from the pouring vessel. Therefore, whereas the metal contained in the supply pipe is recovered in the liquid form after isolation of the mould cavity, the metal yield, which is equal to the ratio between the weight of the cast part obtained and the total weight of solid metal employed, is greatly reduced owing to the head which is essential to the soundness of the cast parts.

A main object of the invention is to avoid in a simple and cheap manner any head and closure device.

For this purpose, the invention provides a method of the aforementioned type, wherein the mould cavity is supplied with metal from the main runner through at least one secondary runner whose sectional size is much smaller than the sectional size of the main runner; the pressure of the gas is maintained until the secondary runner or runners have solidified and then the gas pressure is returned to atmospheric pressure.

Thus, the head is eliminated and it is the main runner itself which constitutes a reserve of metal and it is the or each secondary runner which, once solidified, serves as a closure device for isolating the corresponding mould cavity. As the section of the secondary runner or runners is very small, their solidification occurs while the metal contained in the main runner is still practically completely liquid so that it is possible to fully recover the latter in the vessel when the pressure of the gas is released. Moreover, the excess metal is solely that contained in the secondary runner or runners so that a very high yield of metal is ensured.

It has been found that the soundness of the cast parts is also improved since, even if the cavity has a complex shape, the metal is forced by the pressure in all the corners thereof.

In a preferred manner of carrying out this method, before connecting the main runner to the supply pipe, a pasty refractory and thermosetting coating is applied on the contour of the base of the main runner adapted to cooperate with the upper end of the supply pipe. The junction between the main runner of the mould and the supply pipe is thus achieved in a very simple manner and ensures a perfect seal throughout the time during which the gas pressure is maintained, even if the metal cast is of the type having a high melting point.

By way of a modification, there may also be applied in the same region, with the same advantages, an annular sealing element comprising a core constituted by a high temperature-resistant material and coated on both sides with a pasty refractory and thermosetting coating.

Another object of the invention is to provide a casting apparatus for carrying out the method defined hereinbefore. This apparatus is of the type comprising an upwardly open supply pipe which extends through a wall of an otherwise fluidtight vessel connected to a source of gas under pressure, and at least one sand mould in which are formed at least one mould cavity and a main runner which has a sectional size in the neighbourhood of the sectional size of the supply pipe and communicates with the cavity and has a lower opening which is capable of being adapted to the upper end of the supply pipe, wherein the mould is blind and the main runner is connected to the cavity or each cavity by at least one secondary runner whose sectional size is much smaller than the sectional size of the main runner.

Further features and advantages of the invention will be apparent from the ensuing description given merely by way of example with reference to the accompanying drawings.

Figure 1:
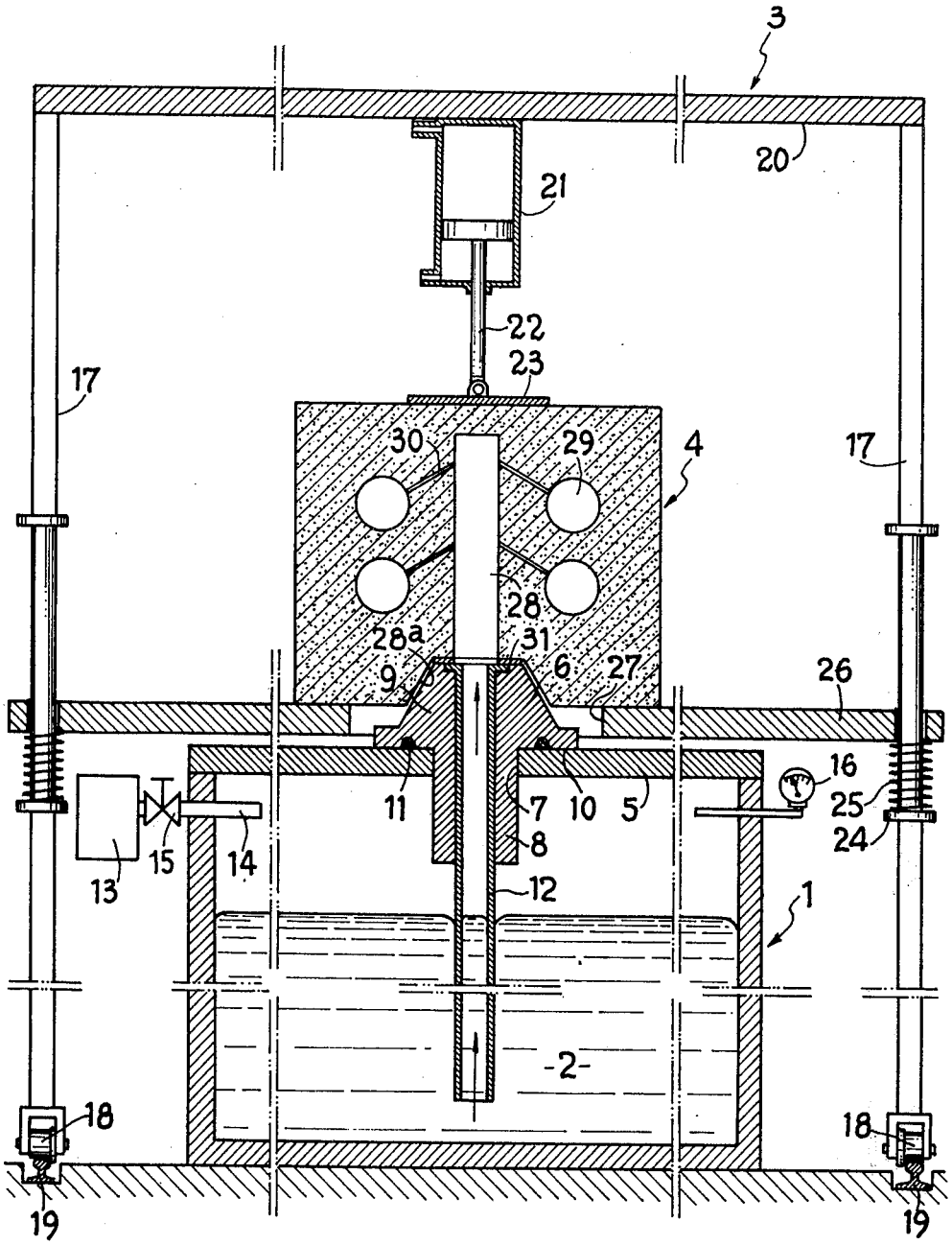
FIG. 1 is a diagrammatic vertical sectional view of a casting apparatus according to the invention.

The apparatus shown in FIG. 1 comprises a vessel 1 containing a supply or reserve of liquid metal 2, a frame 3 supporting the mould and a sand mould 4. The apparatus is applied to the low-pressure casting or iron (grey cast iron or spheroidal graphite cast iron) in the mould 4.

The vessel 1, which is fixed, has an upper cover 5 which is secured in a fluidtight manner to its side walls and locked by suitable means (not shown). An outlet nozzle 6 extends through an aperture 7 in the cover 5 and comprises a tubular lower portion 8 whose outside diameter corresponds to the diameter of the aperture 7 and a generally frustoconical upper portion 9 which bears in a fluidtight manner against the periphery of the aperture 7 by its planar large base 10. A sealing element 11 constituted by a cord of asbestos is disposed in a groove formed in the base 10 of the nozzle. Extending through the nozzle 6 is a supply pipe or conduit 12 of refractory material which is immersed in the iron down to within the vicinity of the bottom of the vessel 1. The upper part of the pipe 12 opens out in the centre of the nozzle 6 at the level of the upper planar face of the latter.

The vessel 1 is connected to a source 13 of gas under pressure by way of a conduit 14, the vessel 1 being put in communication with the source of pressure 13 or with the atmosphere by the action of a suitable device 15 located outside the vessel. A pressure gauge 16 permits a supervision of the pressure prevailing inside the vessel 1 in the course of casting.

The frame 3 has posts 17 provided at their base with wheels 18 bearing on two rails 19. The posts 17 are interconnected in their upper part by a roof 20 carrying a jack 21 which extends downwardly and whose piston rod 22 carries a thrust plate 23 pivoted to its lower end.

The posts 17 also each carry a flange 24 on which there bears a coil spring 25. A horizontal support plate 26 is vertically slidable along a part of these posts 17 above the flanges 24. This plate 26 constantly bears against the upper end of springs 25 and is biased upwardly by the latter. When no downwardly-directed pressure is exerted on the support plate 26, the latter is located at a level higher than the upper face of the nozzle 6. A circular opening 27, of a diameter sufficient to clear the nozzle 6, is formed in the plate 26.

The mould 4 is a massive sand mould constructed in two halves, the joint plane of which is vertical and is the plane of FIG. 1. This mould is blind and comprises a main runner 28 and four impressions or cavities 29 each of which is connected to the main runner by a secondary runner 30.

The main runner 28 is vertical and has a circular cross-section whose size is roughly equal to that of the supply pipe 12. It is open at its base which defines a recess 28$^a$ of frustoconical downwardly divergent shape complementary to that of the nozzle 6. The runner 28 extends upwardly and stops short of the upper end face of the mould.

The four secondary runners 30 are parallel in pairs and downwardly inclined from the main runner 28. Their sectional shape is cylindrical or rectangular and has a size much less than the sectional size of the main runner. How these sections are determined will be explained hereinafter.

Figure 2:
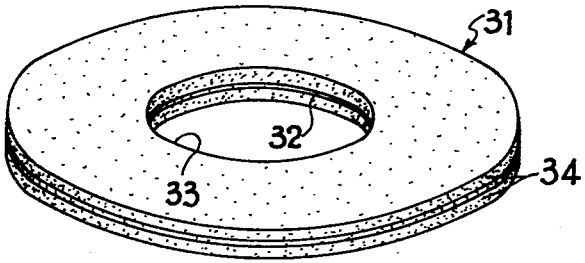
FIG. 2 is a perspective view of a sealing element employed in this apparatus.
Figure 3:
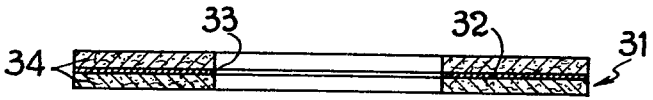
FIG. 3 is a sectional view of the element shown in FIG. 2.

A sealing element 31, shown to an enlarged scale in FIGS. 2 and 3, completes the apparatus. It comprises a core 32 having a flat annular shape and advantageously constituted by asbestos fabric or card having a centre opening 33 whose diameter is roughly equal to that of the main runner 28. This core 32 is covered on both sides with a pasty thermosetting refractory coating 34. This coating is composed of a mixture of refractory paste, such as alumina, silica, asbestos or zircon, and a binder such as sodium silicate, potassium silicate or bentonite, for example containing 95% of alumina and 5% of sodium silicate.

The apparatus operates in the following manner:

With the frame 3 remote from the vessel 1, the sealing element 31 is applied to the inner end of the recess 28$^a$ of the mould 4 and adheres to this inner end owing to the composition of the coating 34 which imparts thereto a certain plasticity. The mould 4 is placed on the support plate 26 and centered on the opening 27 of the latter and then the frame 3 is moved along the rails 19 to a position over the vessel 1 containing liquid iron so that the nozzle 6 faces the recess 28$^a$ of the mould. The jack 21 is then extended so as to lower, by means of the plate 23, the mould 4 and its support plate 26 in opposition to the action of the springs 25. This operation clamps the sealing element 31 between the inner end of the recess 28$^a$ and the nozzle 6. The sealing element 31 is crushed owing to its plasticity and the pasty coating 34 forms a ring around the junction between the supply pipe 12 and the riser 28 of the mould. The crushed sealing element dries and hardens under the action of the heat given off by the nozzle 6, since the latter is constantly at high temperature owing to conduction along the pipe 12 and to the repeated passage of the iron therethrough in the course of each mould filling. These two stages of the crushing and hardening of the sealing element have a very short duration, of the order of a second.

The vessel 1 is then connected to the source of pressure 13 by actuation of the device 15. The pressure acting on the free surface of the liquid iron causes the latter to rise in the pipe 12 and the hardened sealing element ensures a perfect seal. The iron fills the main runner 28 of the mould, the secondary runners 30 and the cavities 29. The pressure is maintained for a given period of time depending on the dimensions and the shapes of the parts to be cast. The runner 28 performs during this time the function of a reservoir or feed head in that it supplies to the cavities the additional liquid iron for compensating for shrinkages. Then the secondary runners 30 solidify, the gas pressure is brought to atmospheric pressure in the vessel 1 by actuation of the device 15, and the liquid iron in the runner 28 and in the pipe 12 flows back into the vessel 1 and thereby empties the pipe and runner.

The action of the jack 21 is then stopped and the mould 4 and support 26 are moved away from the nozzle 6 by the action of the springs 25 and the frame 3 is moved horizontally bodily away from the vessel 1 along the rails 19.

The nozzle 6 is compact and has a smooth surface, it being composed for example of mullite and steel, whereas the sand mould has a granular structure. Consequently, the sealing element 31 adheres with more force to the mould than to the nozzle so that when these two parts are separated, the mould can be removed with the hardened sealing element adhering thereto. The nozzle 6 is thus immediately ready to receive a new mould for a new cycle of operations.

By way of a modification, it could be sufficient to coat the inner end of the recess 28$^a$ of the mould, before bringing the latter above the vessel 1, with a layer of the coating 34 without use of asbestos core 32.

In order that the casting described hereinbefore be carried out in a suitable manner, a number of conditions must be satisfied:

a. The secondary runners 30 must not solidify before it is ensured that the cavities 29 have received a sufficient amount of metal to produce sound parts, bearing in mind shrinkage due to the cooling, deformation of the mould due to pressure, and expansion of the mould due to temperature.

b. However, the secondary runners 30 must solidify as rapidly as possible, nonetheless taking into account the foregoing condition, in order to shorten the duration of the moulding cycle.

c. When the runners 30 are solidified, the iron contained in the main runner 28 must still be practically completely in a liquid state in order to be capable of being completely recovered in the vessel 1 when the pressure is released.

Figure 4:
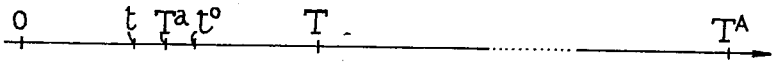
FIG. 4 is a diagram of the times to facilitate the understanding of the invention.

The manner of dimensioning the runners will be deduced from these considerations and will be explained with reference to FIG. 4.

The basic data are: the type of mould and sand employed for the mould; the metal cast; the temperature of the metal at the moment of casting; the pressure of the gas employed; the shape and dimensions of the cast parts (for reasons of simplification, the case will be taken of a single mould cavity and a single secondary runner).

There are determined experimentally and approximately by means of charts, graphs, tables, etc., the time T of solidification of the most massive portion of the cast part and the minimum time $t$ during which the cavity must be supplied with liquid metal in order to obtain a sound cast part. This obviously gives $t < T$.

According to the aforementioned condition (a), $T^a > t$ is necessary, in which $T^a$ designates the solidification time of the secondary runner. However, according to condition (b), $T^a$ must be in the neighbourhood of $t$. $T^a$ is thus chosen and, in choosing the shape of the section of the secondary runner, for example cylindrical or rectangular, the dimensions of this runner are deduced therefrom.

In view of the fact that as soon as the secondary runner is solidified the mould cavity is isolated, and that a prolongation of the time $t^o$ of maintaining the gas pressure would only result in needlessly prolonging the moulding cycle, $t^o$ is chosen to be slightly greater than $T^a$.

It is now merely necessary to dimension the main runner in such manner that its solidification time $T^A$ is much greater than $t^o$. All the foregoing results are grouped in FIG. 4.

A secondary fact to be taken into account is to ensure that a possible suction of the still partly liquid core or heart of the secondary runners does not reach the cast part when the pressure is released. This risk of suction is reduced, on one hand, by the downward inclination of the secondary runners and, on the other, by a control of the rate at which the pressure is lowered.

The following examples show results obtained with a supply pipe having an inside diameter of 45 mm and an outside diameter of 70 mm.

EXAMPLE 1

Clutch fork of grey cast iron cast at 1,300° C in sand with a furannic resin binder.

T = 40 sec.

$t^o$ = 15 sec.

Drop in pressure from 0.7 to 0 bar (relative pressure) within 15 sec.

A single rectangular secondary runner of 10 mm × 6 mm.

EXAMPLE 2

A cylinder head of a four cylinder V-engine of grey cast iron cast at 1,300° C in Croning sand with a phenolic resin binder.

T = 50 sec.

$t^o$ = 30 sec.

Drop in pressure from 0.7 to 0 bar within 15 sec.

Four rectangular secondary runners of 15 mm × 5 mm.

EXAMPLE 3

The same part as in the preceding example of spheroidal graphite cast iron cast at 1,350° C in the same sand as in the preceding example.

T = 50 sec.

$t^o$ = 45 sec.

Drop in pressure from 0.7 to 0 bar within 15 sec.

Four rectangular secondary runners of 15 mm × 10 mm.

Figure 5:
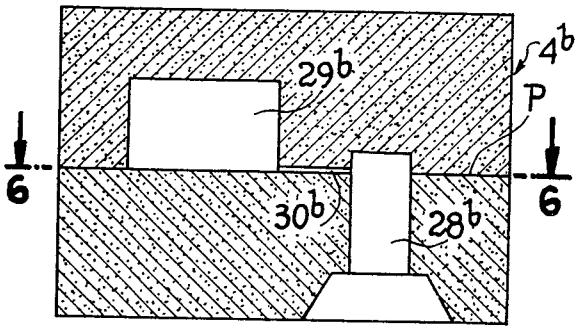
FIG. 5 is a diagrammatic sectional view, taken on line 5—5 of FIG. 6, of another mould which may be employed in the apparatus shown in FIG. 1.
Figure 6:
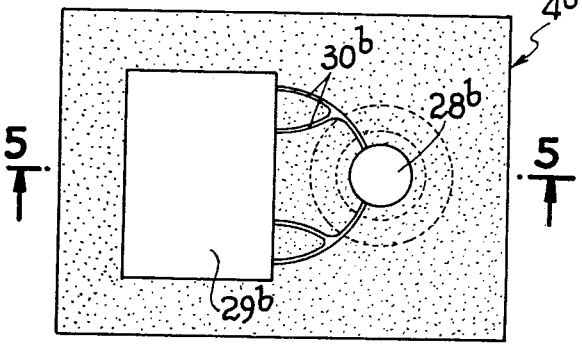
FIG. 6 is a sectional view of this mould taken on line 6—6 of FIG. 5.

The mould $4^b$ employed in the last two examples is shown in FIGS. 5 and 6. Its joint plane P is horizontal and contains secondary runners $30^b$ which open out onto the base of the cavity $29^b$ and on the same side of the latter and lead from a single main runner $28^b$.

The apparatus and the method described hereinbefore have many advantages and in particular:

Owing to the fact that the pressure is maintained, each mould cavity is perfectly filled and supplied with metal so long as the shrinkage must be compensated for. The parts obtained are thus sound, devoid of shrinkage cavities and require very little burr removal. It is possible to cast parts having very thin walls, for example of the order of 3 mm thickness and of complicated shapes.

The feed head is dispensed with and all the iron contained in the main runner is recovered. The metal yield is therefore excellent.

Owing to the use of the sealing element 31 or of merely its coating, the low-pressure casting method may be validly applied to the casting of metals having a high melting point in a sand mould and in particular iron casting, this sealing element affording a perfect seal owing to its practically instantaneous hardening before casting.

Owing to the design of the sealing element, comprising a core covered with a coating, the sealing element may be deposited previously on moulds ready to be employed. The deposition is rapid and easy since the sealing element holds itself in position by simple adherence of the coating to the recess $28^a$ of the mould. The same is true of the simple application of the coating in the recess $28^a$.

When the coating is clamped between the recess $28^a$ of the mould and the nozzle 6, it is spread around the joint and therefore permits the accommodation of any lack of parallelism and of the roughness of the surfaces in contact, possibly due to a droplet of iron remaining from a preceding casting operation, with the result that the casting is very safe.

Owing to the difference in the states of the surfaces of the recess $28^a$ of the mould and the nozzle 6, the sealing element at the end of the casting remains adhered to the mould and is removed at the same time as the latter so that it is possible to place a new mould immediately in position and avoid scraping and cleaning operations on the nozzle 6.

It has been observed that the apparatus performs well and there is a saving in energy. Indeed, practically only the metal of the parts solidifies and the remainder of the iron is recovered in the liquid form and requires merely a slight additional heating.

It is also observed that, owing to the invention, it is possible to cast metals at "low temperature," for example to cast grey iron between 1,200° and 1,320° C or spheroidal graphite iron between 1,250° and 1,350° C.

The gas employed for supplying metal to the mould may be an inert gas, such as nitrogen or simply air, but nitrogen is preferred for the spheroidal graphite iron. Indeed, in this case, the "vanishing" of the magnesium would be thus decreased. The vanishing of the magnesium means a decrease in its content (normal content about 0.030%) when the iron is liquid. This vanishing phenomenon is the greater as the temperature is higher. The fact of being able to cast "relatively cold" (between 1,250° and 1,350° C for spheroidal graphite iron) therefore permits a decrease in these vanishing phenomena. Moreover, this vanishing phenomenon is related to the presence of oxygen. It is therefore still further diminished by the use of an inert gas, such as nitrogen, and by maintaining the free surface of the iron in a confined atmosphere, which is the case, since, during the casting, the vessel 1 is closed and not connected to the atmosphere and casting is carried out in a blind mould.

The invention may be applied to metals having a high melting point other than iron, for example steel.

Having now described our invention what we claim as new and desire to secure by Letters Patent is:

1. A method for low-pressure casting in a sand mould of in particular a metal having a high melting point, comprising providing a blind sand mould defining a main runner which has an open base portion, a mould cavity and a secondary runner whose cross-sectional area is much less than the cross-sectional area of the main runner, said secondary runner extending from a point of the main runner to the mould cavity; applying a pasty thermosetting refractory coating on the surface of the base portion of the main runner; connecting said base portion to a mating upper end of a metal nozzle and a refractory supply pipe which has a cross-sectional area in the neighbourhood of the cross-sectional area of the main runner and partly extends into a fluidtight vessel containing the liquid metal, the lower end of the pipe being immersed in the metal whereby the pasty coating is crushed and hardened into a sealing element; applying a gas pressure exceeding atmospheric pressure on the free surface of the metal contained in the vessel so as to fill the mould cavity with metal under pressure; maintaining the gas pressure until the metal in the secondary runner has solidified; bringing the gas pressure back to atmospheric pressure; and disconnecting said base portion from said mating upper end with said sealing element adhering to said base portion.

2. A method as claimed in claim 1, wherein the coating comprises a mixture of a refractory paste and a binder.

3. A method as claimed in claim 2, wherein the refractory paste comprises a substance selected from the group consisting of alumina, silica, asbestos and zircon.

4. A method as claimed in claim 2, wherein the binder comprises a substance selected from the group consisting of sodium silicate, potassium silicate and bentonite.

5. A method as claimed in claim 1, wherein the liquid metal in said vessel is grey iron at a temperature in the range 1,200°–1,320° C.

6. A method as claimed in claim 1, wherein the liquid metal in said vessel is spheroidal graphite iron at a temperature in the range 1,250°–1,350° C.

7. A method as claimed in claim 1, wherein said gas is air.

8. A method as claimed in claim 1, wherein said gas is an inert gas.

9. A method for low-pressure casting in a sand mould of in particular a metal having a high melting point, comprising providing a blind sand mould defining a main runner which has an open base portion, a mould cavity and a secondary runner whose cross-sectional area is much less than the cross-sectional area of the main runner, said secondary runner extending from a point of the main runner to the mould cavity; applying on the surface of the base portion of the main runner an annular sealing element comprising a core of a material which is resistant to high temperature and is covered on both sides of the core with a pasty thermosetting refractory coating; connecting said base portion to a mating upper end of a metal nozzle and a refractory supply pipe which has a cross-sectional area in the neighbourhood of the cross-sectional area of the main runner and partly extends into a fluidtight vessel containing the liquid metal, the lower end of the pipe being immersed in the metal whereby the pasty coating is crushed and hardened into a sealing element; applying a gas pressure exceeding atmospheric pressure on the free surface of the metal contained in the vessel so as to fill the mould cavity with metal under pressure; maintaining the gas pressure until the metal in the secondary runner has solidified; bringing the gas pressure back to atmospheric pressure; and disconnecting said base portion from said mating upper end with said sealing element adhering to said base portion.

10. A method as claimed in claim 9, wherein the core comprises asbestos.

11. A method as claimed in claim 9, wherein the coating comprises a mixture of a refractory paste and a binder.

12. A method as claimed in claim 11, wherein the refractory paste comprises a substance selected from the group consisting of alumina, silica, asbestos and zircon.

13. A method as claimed in claim 12, wherein the binder comprises a substance selected from the group consisting of sodium silicate, potassium silicate and bentonite.

14. A method as claimed in claim 9, wherein said gas is air.

15. A method as claimed in claim 9, wherein said gas is an inert gas.

16. A method as claimed in claim 9, wherein the liquid metal in said vessel is grey iron at a temperature in the range 1,200°–1,320° C.

17. A method as claimed in claim 9, wherein the liquid metal in said vessel is spheroidal graphite iron at a temperature in the range 1,200°–1,320° C.

* * * * *